US007867382B2

(12) United States Patent
Droughton

(10) Patent No.: US 7,867,382 B2
(45) Date of Patent: Jan. 11, 2011

(54) PROCESSING UNCONVENTIONAL AND OPPORTUNITY CRUDE OILS USING ONE OR MORE MESOPORE STRUCTURED MATERIALS

(75) Inventor: Charlotte Droughton, 2108 Camille, Pasadena, TX (US) 77506

(73) Assignee: Charlotte Droughton, Pasadena, TX (US)

( * ) Notice: Subject to any disclaimer, the term of this patent is extended or adjusted under 35 U.S.C. 154(b) by 0 days.

(21) Appl. No.: 12/727,577

(22) Filed: Mar. 19, 2010

(65) Prior Publication Data

US 2010/0176032 A1 Jul. 15, 2010

Related U.S. Application Data

(63) Continuation of application No. 11/146,914, filed on Jun. 7, 2005, now abandoned.

(51) Int. Cl.
*C10G 25/05* (2006.01)
*C10G 33/00* (2006.01)

(52) U.S. Cl. ..... 208/306; 208/188; 208/251 R; 208/254 R; 208/263; 208/299

(58) Field of Classification Search ..... 208/177, 208/187, 188, 208 R, 248, 249, 251 R, 254 R, 208/255, 262.1, 263, 295, 297, 299, 303, 208/306
See application file for complete search history.

(56) References Cited

U.S. PATENT DOCUMENTS

| | | | | |
|---|---|---|---|---|
| 1,728,059 | A | 9/1929 | Heisig | |
| 3,322,664 | A * | 5/1967 | Paterson et al. | 208/251 R |
| 4,428,828 | A | 1/1984 | Bose | |
| 5,114,689 | A | 5/1992 | Nagji et al. | |
| 5,220,099 | A | 6/1993 | Schreiner et al. | |
| 5,804,060 | A | 9/1998 | Benguigui et al. | |
| 5,814,286 | A | 9/1998 | Hood et al. | |
| 5,843,302 | A | 12/1998 | Hood | |
| 5,914,010 | A | 6/1999 | Hood et al. | |
| 5,919,355 | A | 7/1999 | Hood | |
| 5,944,984 | A | 8/1999 | Benguigui et al. | |
| 5,976,361 | A | 11/1999 | Hood et al. | |
| 6,074,457 | A | 6/2000 | Anthonis et al. | |
| 6,183,627 | B1 | 2/2001 | Friday et al. | |
| 6,225,357 | B1 | 5/2001 | Breen et al. | |
| 6,228,239 | B1 | 5/2001 | Analastas et al. | |
| 6,274,003 | B1 | 8/2001 | Friday et al. | |
| 6,274,032 | B2 | 8/2001 | Hood et al. | |
| 6,357,526 | B1 | 3/2002 | Abdel-Halim et al. | |
| 6,365,038 | B1 | 4/2002 | Doron | |
| 6,402,940 | B1 | 6/2002 | Rappas | |
| 6,524,469 | B1 | 2/2003 | Schucker | |
| 6,531,516 | B2 | 3/2003 | Davis et al. | |
| 2006/0272983 | A1 | 12/2006 | Droughton et al. | |

OTHER PUBLICATIONS

Edmonds, et al., "Measurement and Predication of Asphaltene Precipitation From Live Oils." (1999).

Ramos, et al., "Interfacial and Colloidal Behavior of Asphaltenes Obtained From Brazilian Crude Oils," Journal of Petroleum Science & Engineering 32 (2001) 201-216.

Ancheyta, et al., "Changes in Asphaltene Properties During Hydrotreating of Heavy Crudes," Energy & Fuels 2003, 17, 1233-1238.

Stark, et al., "Crude Oil Blending Effects on Asphaltene Stability in Refinery Fouling," Petroleum Science and Technology, vol. 21, Nos. 3 & 4, pp. 569-579, 2003.

Ng, et al., "Study of Canadian FCC Feeds from Various Origins and Treatments. 1. Ranking of Feedstocks Based on Feed Quality and Product Distribution," Energy & Fuels 2004, 18, 160-171.

Ali, "Evaluation of Feedstocks for Development of Hydrocracking Catalysts for Heavy Oil," Petroleum Science and Technology, 19(9&10), 1063-1074 (2001).

Akbarzadeh, et al., "Methodology for the Characterization and Modeling of Asphaltene Precipitation from Heavy Oils Diluted with n-Alkanes," Energy & Fuels 2004, 18, 1434-1441.

Ancheyta-Juarez, et al., "An Exploratory Study for Obtaining Synthetic Crudes from Heavy Crude Oils via Hydrotreating," Energy & Fuels 2001, 15, 120-127.

Lindemuth, et la., "Improve Desalter Operations," Hydrocarbon Processing 2001, 67-70.

Stark, et al., "New Method Prevents Desalter Upsets from Blending Incompatible Crudes," Oil & Gas Journal 2002, 89-91.

Auflem, "Influence of Asphaltene Aggregation and Pressure on Crude Oil Emulsion Stability," Department of Chemical Engineering Norwegian University of Science and Technology Trondheim, Jun. 2002.

(Continued)

*Primary Examiner*—Glenn Caldarola
*Assistant Examiner*—Randy Boyer
(74) *Attorney, Agent, or Firm*—The Morris Law Firm, P.C.; Paula Morris

(57) ABSTRACT

A process for removing contaminants and breaking emulsions in a feedstream comprising a crude source composition comprising unconventional or opportunity crude oil, the process comprising: providing the feedstream comprising the crude source composition comprising unconventional or opportunity crude oil, the feedstream comprising an emulsion comprising one or more contaminants, a salt content, and a water content; and, contacting the feedstream directly with one or more mesopore structured materials and one or more demulsifiers under conditions effective to separate a majority of the water content, the salt content, and the one or more contaminants from the feedstream, thereby breaking the emulsion and producing a purified hydrocarbon phase.

14 Claims, 1 Drawing Sheet

OTHER PUBLICATIONS

Wu, et al., "Effect of Demulsifier Properties on destabilization of Water-in-Oil Emulsion," Energy & Fuels 2003, 17, 1554-1559.
Laredo, et al., "Identification of Naphtenic Acids and other Corrosivity-Related Characteristics in Crude Oil and Vacuum Gas Oils from a Mexican Refinery," Energy & Fuels 2004.
Sams, et al., "The Practiced Art of Emulsion Resolution in Electrostatic Processes," National Tank Company, Presentation for 1999 Spring Meeting Houston, Texas.
Zheng, et al., "Microstructure of Dispersed Colloidal Particles of Bilayer Cubic Phase," Journal of Dispersion Science and Technology, vol. 24, No. 1, pp. 123-128, 2003.
Liu, et al., "Study on the Compatibility of Asphaltic Crude Oil with the Electric Desalting Demulsifiers," Energy & Fuels 2003, 17, 543-548.
Warren, "Reduction of Corrosion through Improvements in Desalting," Benelux Refinery Symposium, Lanaken, Belgium, 1995.
Al-Otaibi, et al., "Experimental Investigation of Crude Oil Desalting and Dehydration," Chem. Eng. Comm. 190: 65-82, 2003.
Sams, et al., "Emulsion Resolution in Electrostatic Processes," Energy & Fuels 2000, 14, 31-37.
Kim, et al., "Demulsification of Water-in-Crude Oil Emulsions by a Continuous Electrostatic Dehydrator," Separation Science and Technology, 37(6), 1307-1320 (2002).
Tomczyk, et al., "On the Nature and Origin of Acidic Species in Petroleum. 1. Detailed Acid Type Distribution in a California Crude Oil," Energy & Fuels 2001, 15, 1498-1504.
Acevedo, et al., "Isolation and Characterization of Low and High Molecular Weight Acidic Compounds from Cerro Negro Extraheavy Crude Oil. Role of These Acids in the Interfacial Properties of the Crude Oil Emulsions," Energy & Fuels 1999, 13, 333-335.
Skippins, et al., "Corrosion-Mitigation Program Improves Economics for Processing Naphthenic Crudes," Oil & Gas Journal, Sep. 11, 2000, 64-68.
Ostlund, et al., "Interactions Between Asphaltenes and Naphthenic Acids," Energy & Fuels 2003, 17, 113-119.
Rudzinski, et al., "Tandem Mass Spectrometric Characterization of Commercial Naphthenic Acids and a Maya Crude Oil," Energy & Fuels 2002, 16, 1178-1185.
SET Laboratories, Inc., "Naphthenic Acid Corrosion Mechanisms," Feb. 10, 2002.
Hsu, et al., "Naphthenic Acids in Crude Oils Characterized by Mass Spectrometry," Energy & Fuels 2000, 14, 217-223.
Johnson, et al., "Mitigating Corrosion from Naphthenic Acid Streams" (2003).
Havre, "Formation of Calcium Nephthenate in Water/Oil Systems, Naphthenic Acid Chemistry and Emulsion Stability," Department of Chemical Engineering Norwegian University of Science and Technology, Trondheim, Oct. 2002.
McGrath, et al., "Upgrading Options for Heavy Crude Processing," AIChE Spring 1999 Meeting.
Kerr, et al., "The Long Lake Project —The First Field Integration of SAGD and Upgrading," Soc. of Pet. Engrs., SPE/PS-CIM/CHOA, 2002 SPE International Thermal Operations and Heavy Oil Symposium and International Horizontal Well Technology Conference, Calgary, Alberta, Canada Nov. 4-7, 2002.
United States Patent and Trademark Office (USPTO), "Non-Final Office Action," U.S. Appl. No. 11/146,914; Jul. 9, 2008.
The Morris Law Firm, P.C. (MLF), "Response to Non-Final Office Action," U.S. Appl. No. 11/146,914; Oct. 21, 2008.
USPTO, "Final Office Action," U.S. Appl. No. 11/146,914; Jan. 8, 2009.
MLF, "Response to Final Office Action," U.S. Appl. No. 11/146,914; Jan. 27, 2009.
USPTO, "Non-Final Office Action," U.S. Appl. No. 11/146,914; Feb. 18, 2009.
MLF, "Response to Non-Final Office Action," U.S. Appl. No. 11/146,914; Mar. 13, 2009.
USPTO, "Final Office Action," U.S. Appl. No. 11/146,914; Jul. 1, 2009.
USPTO, "Examiner's Interview Summary," U.S. Appl. No. 11/146,914; Oct. 13, 2009.
MLF, "Summary of Telephone Interview," U.S. Appl. No. 11/146,914; Oct. 19, 2009.
USPTO, "Final Office Action," U.S. Appl. No. 11/146,914; Oct. 20, 2009.

* cited by examiner

PROCESSING UNCONVENTIONAL AND OPPORTUNITY CRUDE OILS USING ONE OR MORE MESOPORE STRUCTURED MATERIALS

The present application is a continuation of U.S. application Ser. No. 11/146,914, filed Jun. 7, 2005 (pending).

BACKGROUND

1. Field of the Invention

The invention relates to separation processes and systems to remove or reduce impurities from unconventional and opportunity petroleum resources.

2. Description of the Related Art

Opportunity petroleum resources such as acidic crude oil, extra heavy oil, heavy oil, high salinity crudes, acidic residuum, gas oils, oil sand, diluted bitumen, and undiluted bitumen are typically treated to remove impurities such as asphaltenes, solids, sulfur, NSO, metals, chlorides, water, salts, and acids before sending the resource upstream for additional processing. One currently available treatment is solvent deasphalting (SDA). This process takes advantage of the fact that maltenes are more soluble in light of paraffinic solvents than asphaltenes. This solubility increases with solvent molecular weight and decreases with temperature. There are constraints with respect to how deep a SDA unit can cut into the residue or how much deasphalted oil (DAO) can be produced. Theses constraints are typically due to the DAO quality specifications required by downstream conversion units; and the final high-sulfur residual fuel oil stability and quality.

Solvent deasphalting has the advantage of being a relatively low cost process that has the flexibility to meet a wide range of DAO qualities. The process has very good selectivity for asphaltenes and metals rejection, some selectivity for carbon rejection and less selectivity for sulfur and nitrogen. It is best suited for the more paraffinic vacuum residues as opposed to the high asphaltenes, high metals, and high carbon containing vacuum residues. The disadvantages of the process are that it performs no conversion, produces a very high-viscosity byproduct pitch, and where high quality DAO is required, SDA is limited in the quality of feedstock that can be economically processed.

Delayed coking has been the preferred choice of many refiners for bottom of the barrel upgrading, due to the inherent flexibility of the process to handle highly contaminated residues. Delayed coking provides partial to complete conversion to naphtha and diesel, and almost complete rejection of carbon and metals. In the past, many cokers were designed to provide complete conversion of atmospheric residue to diesel and lighter, and today several cokers still operate in this mode. Most recently, cokers have been designed to produce heavy coker gas oil for catalytic upgrading, and minimize the production of coke. The economics of delayed coking are driven by the differential between transportation fuels and high-sulfur residual fuel oil. The yield slate for a delayed coker can be varied to meet a refiner's objectives through the selection of operating parameters. Coke yield and the conversion of heavy coker gas oil are reduced, as the operating pressure and recycle are reduced and to a lesser extent as temperature is increased. The disadvantages of delayed coking are that it is a thermal cracking process and it is a more expensive process than SDA although still less expensive than other conversion processes on heavier crudes. One common misconception of delayed coking is that the product coke is a disadvantage. Although coke is a low valued byproduct, compared to transportation fuels there is a significant worldwide trade and demand even for high-sulfur petcoke from delayed cokers as coke is a very economical fuel. In the past, most of the fuel coke produces in the U.S. has been exported to Europe and Japan, however, many of the coal burning power producers in the U.S. have now installed scrubbers and are now using or considering the use of petcoke as part of the fuel to their plant. In addition, there have been several 100% petcoke based power plants installed and many more are being considered. Several of these petcoke burning power plants utilize Foster Wheeler's Circulating Fluid-Bed Boiler Technology. In these plants a circulating bed of limestone captures the sulfur. One concern of the power producing companies in the U.S. has been "is there enough low value petcoke?"

One existing process integrates solvent deasphalting and delayed coking technologies. See, McGrath et al, "Upgrading Options for Heavy Crude Processing," presented at AIChE Spring 1999 Meeting. The process purportedly provides synergistic application of the tow base technologies for increased liquid yield and energy utilization. The increased liquid yields are mainly attributable to the extraction of the high-valued DAO prior to coking. The heat integration between the solvent deasphalting and delayed coking sections features utilization of both high and low level coker waste heat sources in the SDA section. Removing the DAO fraction prior to delayed coking has two benefits. In the coking process this fraction is thermally cracked to extinction, degrading this material as an FCC feedstock. In addition, in thermally cracking this material to extinction, a significant portion will convert to coke. The process purportedly operates with deasphalted oil, both virgin and hydrotreated, and produces as much as 20 wt % coke at higher pressures and recycle rates. A delayed coker pilot plant has also been modified to operate on SDA pitch. This pilot plant has purportedly operated on feedstocks having ring and ball softening points as high as 295° F. With this process there is a significant reduction in byproduct fuel as compared to either solvent deasphalting or delayed coking. The operation can be tailored to meet the ability of a refinery to process a specific quantity or quality of cracking stock.

Production of usable hydrocarbons from unconventional and opportunity crudes has been the subject of much research since the oil crisis of 1973, and even before. The EIA has indicated there are 301.0 BBO of heavy oil and 531.0 BBO of bitumen currently recoverable in the Western Hemisphere. High acid crude processing (as a percent of total crude processed) is expected to grow from about 8.5% in 2004 to about 10.3% in 2009.

The traditional application of in situ production techniques involved drilling a well into the oil sands and extracting the bitumen almost as if it were conventional crude oil. The maturation of horizontal well technology and the development of steam assisted gravity drainage (SAGD) extraction techniques have revolutionized the in situ production industry. With the SAGD technology, two horizontal wells are drilled into the same reservoir, one directly above the other. Steam is injected into the top well, which heats up the surrounding tar-like bitumen and causes it to drain with the aid of gravity into the well bore of the lower well.

A separation train for producing and upgrading heavy oil and bitumen was reported by Kerr et al., "The Long Lake Project—The First Field Integration of SAGD and Upgrading," Soc. Of Pet. Engrs., SPE/PS-CIM/CHOA, 2002 SPE International Thermal Operations and Heavy Oil Symposium and International Horizontal Well Technology Conference, Calgary, Alberta, Canada, 4-7 Nov. 2002 (hereinafter Kerr et al.). This publication describes a process for upgrading heavy oil and bitumen. The process produces a light, sweet synthetic crude from SAGD and an upgrading process that includes distillation combined with solvent deasphalting to partially upgrade bitumen and produce an asphaltenes by-product. The partially upgraded bitumen is then processed in a hydrocracker to produce what is termed a premium synthetic crude. The asphaltenes are fed to an asphaltenes gasification system to produce hydrogen for the hydrocracker and syn gas fuel for the SAGD process.

With the depletion of conventional oil supplies; bitumen extracted from oil sands has become a more attractive source of unconventional crude. The USA and Canada have the world's largest oil sand reserves, which are estimated to be 58.1 billion barrels and 1.6 trillion barrels, respectively. Bitumen contained in the oil sand is highly viscous with API gravities from 1 to 10. Bitumen is made up primarily of distillate and vacuum gas oil cuts in addition to contaminants such as solids, asphaltenes, carboxylic and other organic acids, salts, heteroatoms such as sulfur, nitrogen, and oxygen, and heavy metals. Bitumen must first be separated from the oil sand, and then upgraded before it can be used as a refinery feedstock.

The three major bitumen recovery technologies are surface mining, SAGD, and thermal treatment. SAGD is commercially proven and is used to recover bitumen that is not accessible by surface mining. However, SAGD requires large amounts of steam and is quite energy intensive. Thermal treatments such as vacuum pyrolysis are presently under investigation and development. This process produces less environmental pollution than the other two processes but consumes large amounts of energy. The surface mining process is widely used commercially.

Surface mining is currently used to recover bitumen from oil sands and includes process steps such as oil sands mining, bitumen extraction, and bitumen separation. The bitumen product is then sent to upgrading. Two major procedures for extraction and separation involves 1) water extraction, which uses hot water and caustic to wash and float the bitumen from the sand, and 2) organic solvent extraction, which employs an organic solvent to dissolve the bitumen from the surface of the oil sand. The disadvantages of the solvent extraction process are: environmental pollution due to the loss of solvent; storage of solvent inventories; large quantities of water are required to remove the solvent from the sand after extraction; and difficulties in process scale up.

In a currently practiced hot water extraction process oil sand is first washed by hot water and caustic to form a three-phase suspension made up of bitumen, water, and solids. The suspension (which may or may not also include an emulsion layer), which as been diluted with naphtha, enters a separation system involving gravity separation, flotation, centrifugation, and distillation where bitumen, solids, water, and naphtha are separated from each other. If the hot water extraction and the separation operations are successful, the bitumen product will contain very low concentrations of solids and water, and will be ready for downstream upgrading by coking or hydrocracking. A synthetic crude oil is produced by the upgrading process. However, various problems exist in the extraction and separation steps, which may lead to ineffective separation of the bitumen, solids, and water that may result in: large quantities of water usage and disposal in the tailings pond; environmental pollution; high energy consumption; unacceptable bitumen quality.

Available extraction and separation processes are encumbered with several problems. One problem is low bitumen extraction rate due to the existence of asphaltenes, salts, acids, and extra fine particles at the silica-water interface, and water-oil interface, the bitumen strongly adheres to the sand particles. The displacement efficiency of removing bitumen from the sand is low by hot water extraction alone. The remaining bitumen in the oil sand tailings is not only an issue with regard to bitumen yield, but also may be an environmental problem.

Emulsions present another problem. After the bitumen is displaced from the sand by hot water and caustic, a stable bitumen-water emulsion may form. The emulsion is stabilized by asphaltenes, salts, fine particles, and acids (specifically carboxylic and other organic acids with the previous referred to herein as naphthenic acids) at the bitumen-water interface. The emulsion is difficult to break by the conventional separation techniques in the existing process and will be either disposed o fin the tailings pond or carried over in the bitumen product. The emulsion that is carried over may cause serious problems in the downstream processes, such as corrosion, fouling, catalyst deactivation, and decreased operating efficiency.

Likewise, suspended fine particles smaller than 10 microns are very difficult to remove by flotation, gravity separation, or centrifugation. The fine particles are also responsible in part for formation and stabilization of emulsions, and will cause plugging problems in downstream processes. Fines may also prohibit bitumen droplet coalescence.

Furthermore, asphaltenes have higher aromaticity, low H/C molar ratio, high heteroatoms content (e.g. N, S, and O, commonly referred to as "NSO"), and contain heavy metals such as V and Ni. Asphaltenes have a higher molecular weight as compared with lighter petroleum fractions, and are the most difficult portion of the feedstock to upgrade. The dispersed colloidal asphaltenes particles play an important role in emulsion stabilization. Asphaltenes at the surface of bitumen droplets may also inhibit coalescence.

Additionally, heavy metals such as vanadium and nickel are normally associated with asphaltenes while NSO in the bitumen are associated with both resins and asphaltenes. Heavy metals may deteriorate catalyst activity in downstream operations, and may cause serious environmental problems if handled improperly. NSO are also important elements for air pollution generation. To remove some of these heteroatoms prior to $So_x$ and $No_x$ production would be beneficial. However, the processes discussed above typically do not remove the heavy metals or NSO contained in asphaltenes and resins. These contaminants are sent downstream with the bitumen for pollutant generation.

Carboxylic acids, commonly referred to as naphthenic acids, which are in the bitumen are another important surfactant to stabilize bitumen-water emulsions. These acids may also cause serious environmental pollution if released with water. Naphthenic acids, which are actually classified as resins, also contain a high level of heteroatoms. The current hot water extraction and separation process is not designed for naphthenic acid removal, except as salts which may contribute to emulsion stabilization.

The above problems are characteristic deficiencies of the current hot water extraction technology. In order to solve the problems, an effective and efficient bitumen extraction, separation, and upgrading technology needs to be developed.

U.S. Pat. No. 6,357,526 (Abdel-Halim, et al.), discusses field upgrading of heavy oil and bitumen. Additionally, the following patents assigned to Ormat, Inc., are related to deasphalting technology: U.S. Pat. Nos. 5,804,060; 5,814,286; 5,843,302; 5,914,010; 5,919,355; 5,944,984; 5,976,361; 6,183,627; 6,274,003; 6,274,032; and 6,365,038.

Lindemuth, P. M., et al., "Improve Desalter Operations" Hydrocarbon Processing, (September 2001) discusses adding dispersant to a desalter to prevent asphaltenes precipitation. This was referred to as desalter instability and can lead to shorter run lengths. Thus this paper suggests deasphalting ahead of the desalter contributes to increased run lengths. The same paper purports that asphaltenes removal upstream of the desalter allows the utilization of crudes that traditionally would present problems in blending. Additionally, a reduction in the load of asphaltenes, salt, and solids challenging the existing desalter is reduced, potentially increasing throughout.

Therefore, notwithstanding existing processes for producing synthetic crude oils, what is needed in the art are processes and systems for: carboxylic acid removal to eliminate requirement of opening naphthenic rings; removal of solids, especially solid fines, and carbon residue; asphaltenes removal and viscosity reduction, i.e. deasphalting; water, salts, and metals removal; and/or removal of heteroatoms as found in naphthenic acids and asphaltenes.

Stable emulsions and asphaltenes cause serious problems for oil refiners. Emulsions complicate refinery operations and lead to operational upsets and production losses. A cost effective way to break emulsions and separate the two liquid phases would be valuable to all companies operating process plants, especially to refining companies. Asphaltenes, the heaviest and most contaminated component of petroleum, in addition to salts, and organic acid (specifically the carboxylic acid family of which naphthenic acids are a part) prevent refiners from using very much of the heavier, and cheaper, grades of petroleum as feedstocks. Cost effective and efficient removal of asphaltenes, salts, and naphthenic acids could upgrade the petroleum, turning the heavy crude into a valuable and lighter refinery feedstock, and potentially reducing our country's dependence on foreign oil.

SUMMARY

In one embodiment, the application provides a process for removing contaminants and breaking emulsions in a feedstream comprising a crude source composition comprising unconventional or opportunity crude oil, the process comprising contacting the feedstream comprising unconventional or opportunity crude oil and comprising an emulsion directly with one or more zeolitic materials and one or more demulsifiers, thereby breaking the emulsion and producing a purified hydrocarbon phase.

In another embodiment, the application provides a process for removing contaminants and breaking emulsions in a feedstream comprising a crude source composition comprising unconventional or opportunity crude oil, the process comprising:

providing the feedstream comprising the crude source composition comprising unconventional or opportunity crude oil, the feedstream comprising an emulsion comprising one or more contaminants, a salt content, and a water content; and, contacting the feedstream directly with one or more mesopore structured materials and one or more demulsifiers under conditions effective to separate a majority of the water content, the salt content, and the one or more contaminants from the feedstream, thereby breaking the emulsion and producing a purified hydrocarbon phase.

In yet another embodiment, the application provides a process for removing contaminants and breaking emulsions in a feedstream comprising a crude source composition comprising unconventional or opportunity crude oil, the process comprising:

providing the feedstream comprising the crude source composition comprising unconventional or opportunity crude oil, the feedstream comprising an emulsion comprising one or more contaminants, a salt content, and a water content; and, diluting the feedstream, producing a diluted feedstream;

contacting the diluted feedstream with a first mesopore structured material and the one or more demulsifiers under separation conditions effective to produce first phases comprising a solid phase and an aqueous phase;

separating at least a portion of the solid phase and at least a portion of the aqueous phase from the first phases to leave a remainder comprising a hydrocarbon phase.

In another embodiment, the application provides a process for removing contaminants and breaking emulsions in a feedstream comprising a crude source composition comprising unconventional or opportunity crude oil, the process comprising:

providing the feedstream comprising the crude source composition comprising unconventional or opportunity crude oil comprising an emulsion, the feedstream comprising one or more contaminants, a salt content, and a water content; and, contacting the feedstream directly with one or more zeolitic materials and one or more demulsifiers under conditions effective to separate a majority of the water content, the salt content, and the one or more contaminants from the feedstream, thereby breaking the emulsion and producing a purified hydrocarbon phase.

In yet another embodiment, the application provides a process for removing contaminants and breaking emulsions in a feedstream comprising a crude source composition comprising unconventional or opportunity crude oil, the process comprising:

providing the feedstream comprising the crude source composition comprising unconventional or opportunity crude oil comprising an emulsion, the feedstream comprising one or more contaminants, a salt content, and a water content; and, diluting the feedstream, producing a diluted feedstream;

contacting the diluted feedstream with a first zeolitic material and one or more demulsifiers under conditions effective to separate a majority of the water content, the salt content, and the one or more contaminants from the feedstream, thereby breaking the emulsion and producing a purified hydrocarbon phase.

In another embodiment, the application provides a process for removing contaminants and breaking emulsions in a feedstream derived from a crude source composition comprising unconventional or opportunity crude oil, the process comprising:

providing the feedstream wherein the unconventional or opportunity crude oil is selected from the group consisting of acidic crude oil, extra heavy oil, heavy oil, high salinity crudes, acidic residuum, oil sand, diluted bitumen, undiluted bitumen, and a mixture thereof, the feedstream comprising an emulsion comprising one or more contaminants, a salt content, and a water content;

contacting the feedstream with one or more mesopore structured materials and one or more demulsifiers under conditions effective to separate a majority of the water content, the salt content, and the one or more contaminants from the feedstream, thereby breaking the emulsion and producing a purified hydrocarbon phase.

In another embodiment, the application provides a process for removing contaminants and breaking emulsions in a feedstream derived from a crude source composition comprising unconventional or opportunity crude oil, the process comprising:

providing the feedstream wherein the unconventional or opportunity crude oil is selected from the group consisting of acidic crude oil, extra heavy oil, heavy oil, high salinity crudes, acidic residuum, oil sand, diluted bitumen, undiluted bitumen, and a mixture thereof, the feedstream comprising an emulsion comprising one or more contaminants, a salt content, and a water content;

contacting the feedstream with one or more zeolitic materials and one or more demulsifiers under conditions effective to separate a majority of the water content, the salt content, and the one or more contaminants from the feedstream, thereby breaking the emulsion and producing a purified hydrocarbon phase.

DETAILED DESCRIPTION

Figure 1:
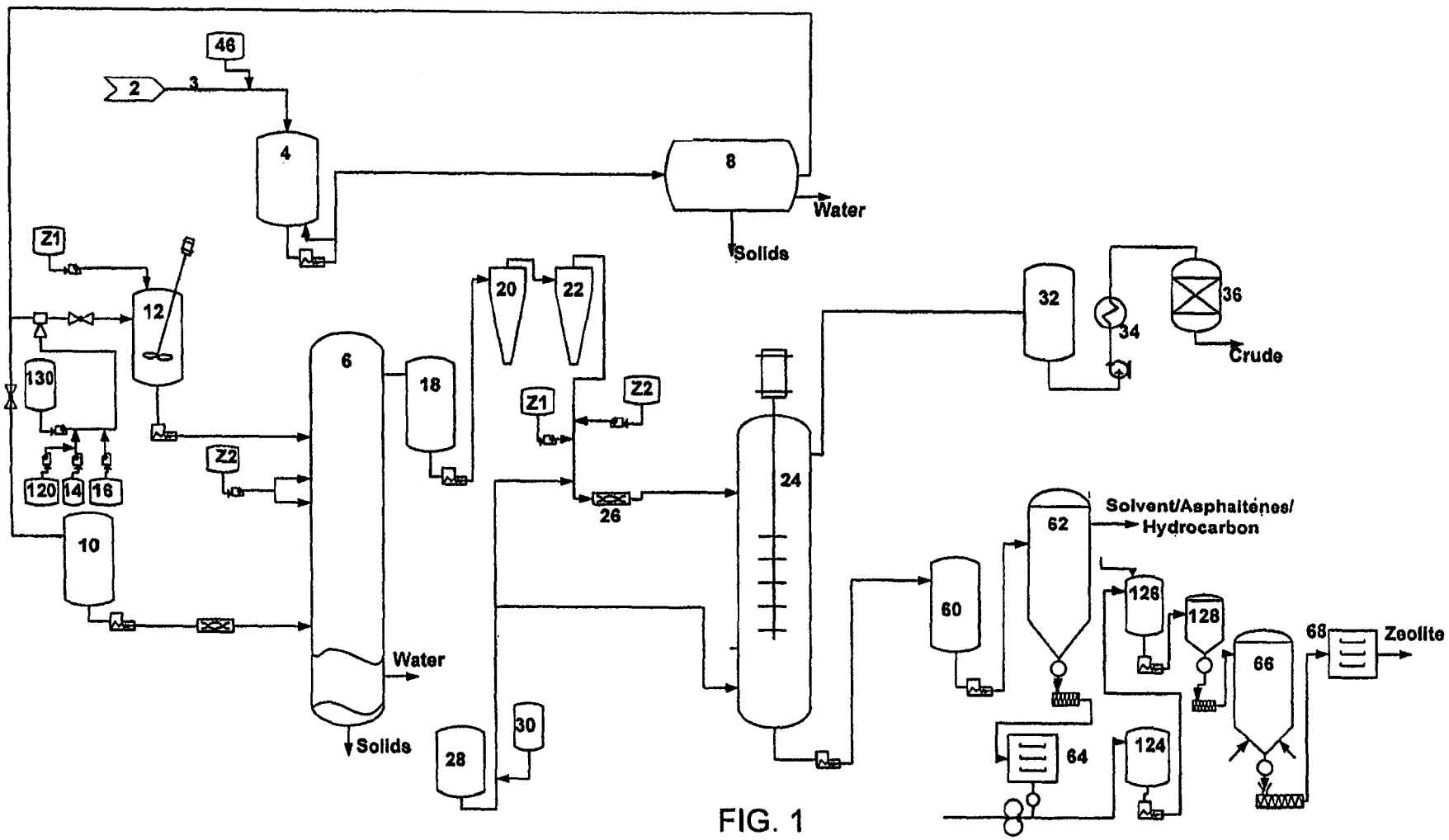
FIG. 1 illustrates a process for treating opportunity crude embodying aspects of the disclosure.

As used herein, the terms "heavy oil" and "bitumen" follow those definitions provided by The United Nations Information Centre for Heavy Crude and Tar Sands, which defines bitumen as petroleum having a viscosity >10,000 centipoise (cP); petroleum with viscosity less than 10,000 cP and a density between 10° API and 20° API is defined as heavy oil; and extra heavy oil has a density <10° API. As used herein, solids fines means solid particles having an average particle size in their largest dimension as follows (Tiller, F. M., and Li, W., *Theory and Practice of Solid/Liquid Separation,* $4^{th}$ Ed., (2002)): 0.1 micron-10 microns is defined as a fine particle; 0.001-0.1 micron is colloidal; and <0.001 micron is molecular.

Untreated heavy oil or bitumen may have the characteristics reported by Schucker, U.S. Pat. No. 6,524,469, and reported in Table 1.

TABLE 1

| Petroleum Characteristics (Heavy Oils and Bitumen) | |
|---|---|
| Conradson Carbon | 5 to 40 wt. % (ASTM D189-165) |
| Sulfur | 1.5 to 8 wt. % |
| Hydrogen | 9 to 11 wt. % |
| Nitrogen | 0.2 to 2 wt. % |
| Carbon | 80 to 86 wt. % |
| Metals | 1 to 2000 wppm |
| Boiling Point | 340 C.+ to 566 C.+ |
| Gravity | 10 to 20. degree. API |

In addition, salts in these petroleum sources may contain form about 50 pounds per thousand barrels (ptb) up to about 1000 ptb or higher, solids fines ranging from 1 to 90 percent of the solids. Fines may be dispersed in the oil phase or carried in suspension in the brine droplets. In addition to the fines in the oil sands themselves, occurring as finely divided siliceous matter, such as silt, and the like, the solids may be entrained drilling mud used in drilling the well or in its rehabilitation, or still further they may be iron rust, scale, and other such type of material, picked up by the oil during the course of its passage through pipelines, tanks, valves, and the like. These materials can contribute to the plugging of distillation towers and heat exchanges, in addition to eroding equipment and contaminating residual products if not reduced or eliminated.

The following abbreviations are used herein: SAGD—steam-assisted gravity drainage; CDC—crude distillation complex; ACDE—atmospheric crude distillation unit; VDU—vacuum distillation unit; DAU—deasphalting unit; DAO—deasphalted oil; ASU—air separation unit (cryogenic, adsorption, or membrane); FCC—fluidized catalytic cracking unit; HT—hydrotreating unit; TSS—total suspended solids; and HC—hydrocracking unit.

The present disclosure provides a process for treating petroleum-containing compositions such as acidic crude oil, extra heavy oil, heavy oil, high salinity crudes, acidic residuum, gas oils, oil sand, diluted bitumen, undiluted bitumen, or a combination thereof to remove one or more impurities such as asphaltenes, solids, sulfur, NSO, metals, nitrogen, chlorides, water, salts, and/or acids. According to one embodiment, a feed stream containing one or more of these petroleum compositions is treated to remove a portion of free water and bulk solids from the stream. For example, the stream can be contained in a vessel such as a separator unit to allow a portion of the water and solids in the stream to settle to the bottom of the vessel. The stream can then be separated from the settled water and/or solids.

According to one embodiment, a liquid hydrocarbon solvent is added to the feed stream to adjust the density and/or viscosity of the feed stream. Suitable solvents include naphtha, normal alkenes, and kerosene. Straight run naphtha is a particularly suitable solvent. The amount of solvent generally required is typically less than that required in conventional processes, due to the subsequent steps, as explained further below. The amount of naphtha required depends on the viscosity and density of the feed. Additionally, the separation process can be operated at a temperature of about ambient to about 100° F. The system can be operated at higher temperatures, but this may not be economically optimal. Likewise, in a low pressure system i.e., about ambient to about 150 psi; the system can also be operated under higher pressure (above 150 psi), but this might be cost prohibitive. Temperature elevation typically results in reduced solvent requirement. According to one embodiment, at ambient conditions about a 1:2 solvent to feed ratio for heavy crude is used to provide separation of heavy crude, which also contains a stable emulsion. Higher diluent to feed ratios, for example, up to about 3-4:1 or higher, may be desirable. For comparison, some commercial SDA units run diluent to feed ratios ranging up to 12:1. However, these units are for deasphalting only and the commercial SDA units do not process emulsions. Contrarily, the disclosed process is ideally suitable of processing emulsions. The naphtha is not required to be a pure hydrocarbon. The boiling range of the naphtha might be, for example, about 20° C. to About 80° C. According to one embodiment, a naphtha cut is taken from a diluent recovery unit, as explained further below.

According to one embodiment, an acid can be added to the feed stream. It may be desirable to add acid to the pH of the feed stream greater than about 9. Suitable acids include sulfuric acid, hydrochloric acid, and nitric acid. Sulfuric acid is particularly suitable. According to one embodiment, acid is added to the feed stream to achieve a pH of about 7 to about 9.

According to one embodiment, a caustic agent can be added to the feed stream. At high caustic concentrations, acids can be drawn from the oil phase to the oil/water interface where they can be ionized. Subsequently, the acid ions enter the water phase due to differences in concentration and polarity. When the oil phase contains no acids, the interfacial tension (IFT) increases. As the emulsion's IFT increases, the stability of the emulsion decreases, ultimately resulting in phase separation. Suitable caustic agents include, for example, sodium hydroxide and calcium hydroxide. Sodium hydroxide is a particularly suitable caustic agent. According to one embodiment, caustic agent is added to the feed stream to achieve a pH of about 8 to about 9.

According to one embodiment, a demulsifier can be added to the feed stream. It is within the ability of one of skill in the art to select an appropriate demulsifier based on their particular petroleum composition. One of skill in the art will appreciate that individual demulsifiers can be extremely crude oil- or region-specific. Exemplary demulsifiers include high molecular weight polymeric emulsifiers. Demulsifiers can be cationic, anionic, or non-ionic and can be commercially obtained (e.g., Baker Hughes Incorporated, Houston, Tex.).

According to an embodiment, a coagulant or flocculent can be added to the feed. Also, an asphaltenes precipitant can be added to the feed. Exemplary asphaltenes precipitants include alkanes such as hexanes and pentanes, possible mixed with light aromatic compounds such as trimethyl benzene.

An aspect of the disclosed method involves contacting the composition with one or more zeolite materials to remove one or more impurities such as asphaltenes, solids, sulfur, NSO, metals, chlorides, water, salts, and acids from the composition. Particularly useful zeolites include natural or synthetic crystalline aluminosilicates. The zeolites are "mesopore-structured materials," meaning that they are crystalline or amorphous metal oxides having essentially regularly structured pore systems wherein the average size of the pores is, for example, in the range of about 1.5 to about 5 nanometers. Exemplary zeolites are the Z-type zeolites, which may be natural, synthetic, or combinations thereof and typically have the chabazite structure. These may be used alone or in conjunction with other zeolite types, such as the A, X, and Y types. In some cases it may be advantageous to blend the zeolite with other filter aids such as bentonites, or diatomaceous earth. The natural or synthetic material can be ground to achieve a particular particle size distribution, and may be chemically and/or physically modified, for example, through ion exchange, to achieve optimal separation characteristics for a given heavy oil or bitumen being treated. Examples of zeolites having asphaltenes adsorption properties that are useful include natural and synthetic zeolites belonging to the following structural classification families: BEA, CHA, EMT, ERI, FAU, FER, GIS, HEU, LTA, LTL, MAZ, MEI, MEL, MFI, MOR, MTW, OFF, ZSM-2, ZSM-18, ZSM-48 and mixtures thereof. Specific zeolites as members of these classes are BEA: beta, tschernichite, etc.; CHA: chabazite, Linde D, Linde R, phi, etc.: EMT: ZSM-3, ZSM-20, hexagonal faujasite, etc.; ERI: erionite, LZ-220, etc.; FAU: faujasite, type X zeolite, type Y zeolite, etc.; FER: ZSM-35, Fu-9, etc.; GIS; synthetic zeolite P, TMA-gismondine, etc.; HEU: clinoptilolite, heulandite, LZ-219, etc.; LTA: type A zeolite, alpha, ZK-4, etc.; LTL: Linde type L, LZ-212, perlialite, etc.; MAZ: ZSM-4, omega, etc.; MEL: silicalite-II, TS-2, etc.; MFI: ZSM-5, silicalite-I, etc.; MOR: large port mordenite, LZ-211, zeolon, etc.; MTW: Nu-13, theta-3, etc.; and OFF: offretite, Linde type T, LZ-217 etc. For more information on those structures, cf., W. M. Meier, D. H. Olson, and Ch. Baerlocher, *Atlas of Zeolite Structure Types*, Elsevier, London, Boston, 1996. Specific examples of zeolites that are preferred for use in producing the adsorbent compositions disclosed herein are natural zeolites, such as mordenite, erionite, clinoptilolite and chabazite, and synthetic zeolites, such as type X zeolite, type A zeolite, type Y zeolite, mordenite, chabazite and ZSM-5. A particularly preferred zeolite is type Z zeolite, known under the trade designation Z-1, and is preferably used in dehydrated form. Exemplary zeolites include the ZS500 zeolites, available from GSA Resources, Inc. (Tucson, Ariz.).

Some of the zeolites, herein termed Z2, have a positive surface charge. The positive surface charge is obtained by surface modification using, for example, long carbon chained surfactant molecules with a cation at the head. The Z2 zeolites are particularly effective for enhancing the adsorption of asphaltenes by adsorbents that weakly adsorb other hydrocarbons from crude hydrocarbon/water mixtures. Thus, the adsorbents are particularly effective for separating asphaltenes from crude or pretreated oil mixtures, such as degassed, dewatered, density modified heavy oils and bitumens. The anions and hydrocarbons are attracted to the positive surface charge of the Z2 zeolites. This makes it possible to operate downstream upgrading units much more effectively than was formerly possible.

Z2 zeolites also function as a cationic coagulant. Asphaltene molecules become adsorbed in multiple pores of multiple zeolite particles, and the portions of the asphaltenes molecules not adsorbed function to attract and collect further charged species (ions, molecules, portions of molecules, and the like). Networks of zeolite particles held together with asphaltenes and other crude oil impurities are formed. The networks are held together through hydrogen, van der Waals, ionic and, in some cases, covalent bonds. Exemplary Z2 zeolites include the SMZ line of zeolites available from GSA Resources, Inc. (Tucson, Ariz.).

Other zeolites, termed Z1, have a negative surface charge. It is possible for anions to become trapped in the pore of Z1 zeolites due to a local electro static field resulting from an imbalance in charge (net positive) due to the oxygen molecules at the corners of the tetrahedron cage. However this can only happen from impaction of the anion close to the cage, which allows the anion to get past the natural negative surface charge of Z1. As long as the species are able to fit into the pores, they have the possibility of being adsorbed, if they have the correct chemical and physical properties, primarily size and charge. A second function of Z1, is to serve as an anionic coagulant.

Z1 affects surfactant behavior at the oil-water interface and influences water induction and coalescence. For example, an emulsion treated with Z1 breaks as much as ten times faster than an untreated emulsion.

Contacting a petroleum composition with a combination of zeolite and demulsifier can cause oil to dehydrate under conditions at which demulsifier alone does not work because salts and/or cations desorb into the water phase or adsorb to the surface of the zeolite. Enough of the surfactants such as acids, salts, asphaltenes, and resins are removed by the zeolite such that water does not remain dispersed in the oil phase. Exposure to the zeolite surface/pores and demulsifier causes films around the water droplet to drain, rupture, and coalesce. Surfactants are adsorbed from the oil-water interface to the zeolite and/or into the water phase.

It may be desirable to process zeolite(s) Z1/Z2, for example by grinding or the like, to achieve a particular particle size distribution (PSD). The PSD can be adjusted, depending on the particular petroleum composition and conditions, to achieve optimum settling velocity of the zeolite(s).

FIG. 1 illustrates an embodiment of the disclosed process. Referring to FIG. 1, fluid streams flow in conduits between the unit operations. Typically, the conduits are designated with odd numbers or are not numbered. Stream 3 designates a previously diluted, extra heavy crude or bitumen such as Athabasca entering an existing refinery. Previously diluted extra heavy crude or bitumen 2 is routed via conduit 3 to a heated surge tank 4 and then to a bulk separator 8. The contents of stream 3 can be blended with naphtha from tank 46. This stream can optionally undergo in-line injection of additional naphtha, for example, via a flow through a static mixer unit. The mixture is then routed to a mixer tank 12 and then to extractor 6 for surfactant removal. Mixer tank 12 can be heated. Prior to entering extractor 6, demulsifier can be added to the stream or into the first top few stages of the extractor 6. The flow arrangement of extractor 6 can be countercurrent or co-current depending on the crude and based on the best arrangement determined in laboratory testing. FIG. 1 illustrates a co-current arrangement. Extractor 6 preferably removes a substantial amount of bulk solids having particles size greater than or equal to fines, wash water containing salt and other ions, and zeolite particles containing salts, acids, fines, asphaltenes, ions and other surfactants.

The amount of naphtha generally required in extractor 6 is typically less than that required in conventional processes, due to the subsequent steps in the process explained below. The amount of naphtha required depends on the viscosity and density of the extra heavy crude mixture which arrives at the refinery previously diluted. The separation process is typically operated at a temperature of about ambient to about 100° F. The system can be operated at higher temperatures, but doing so may not be economically optimal. Likewise, in a low pressure system i.e., about ambient to about 150 psi; the system can also be operated under higher pressure (above 150 psi), but this might be cost prohibitive. This temperature elevation also results in reduced diluent requirement. Addition of zeolite particles further reduces diluent requirement. For example, at ambient conditions, a 1:2 diluent to feed ratio for heavy crude accomplishes separation of heavy crude containing a stable emulsion. Alternatively higher diluent to feed ratios such as 3-4:1 can be used.

The aqueous feed mixture used in extractor 6 can be prepared by mixing several components with water and the heated extra heavy crude/bitumen and diluent in mixing tank 12. For example, optionally a coagulant 120, a base 14, or acid 16 can be routed to tank 12 for particle size and/or pH manipulation. One or more zeolites can also be added to mixing tank 12 (FIG. 1 illustrates Z1 being added to the mixing tank). Alternatively, zeolite(s) can be added directly to extractor column 6 (FIG. 1 illustrates Z2 being added to the extraction column). Depending on crude contaminant load, zeolites Z1 and Z2 are combined in specific ratios ranging from 10:1 or 1:10 to provide optimum removal of fines, salts, acids, ions, other surfactants, and small amounts of asphaltenes which are also functioning as surfactants. According to one embodiment, only one of Z1 or Z2 is used during the surfactant removal extraction. The oil/water/slurry is then routed from tank 12 to extractor 6.

The zeolite is originally in particulate form, and can be formed into a slurry, for example with naphtha, an aliphatic hydrocarbon, naphtha, or naphtha spiked with additional treatment chemicals. Slurried zeolite can be transferred to an agitated surge tank through a conduit, or directly to the next few stages directly beneath the demulsifier injection stages. Transferring can be done by one or more units selected from rotary pump, air pump, reciprocating pump, centrifugal pump, gravity feed, gas pressure, blower, compressor, and the like. The amount of zeolite added depends on the suspect or known amount of asphaltenes molecules and other impurities in the composition.

In extractor 6, there may be mixing at each stage of the column. There can be a quiet zone at the top of the column above the mixing section where product accumulates as column extract, and settling zone at the bottom of the column, below the mixing section, where water, solids, and other contaminates accumulate as raffinate. Due to density differences, the crude feed/diluent rises up in the column as the water and solids fall to the bottom into the settling zone. There is intimate mixing at each stage of extractor 6 taking advantage of the co-current arrangement, resulting in efficient removal of water, salt, solids, and contaminants from the crude. Extractor 6 represents a process of multiple steps of mixing and settling carried out in one vessel. Additives such as the demulsifier and zeolite can maintain interfacial tension so that emulsions break and are difficult to reform.

Optionally, with some heavy or extra heavy crudes, a countercurrent extractor configuration may result in better extract quality. In this case, the heated feed (possible with a small amount of diluent) is routed to a surge tank 10, and it is fed into the extractor 6. Slurry of zeolites Z1 and/or Z2 can be added to extractor 6 via tank 12 or directly to the column. The naphtha can be added into the system via the bottom entry into the extractor 6. If the demulsifier is aqueous based, it can be injected in-line to and be added with the zeolite (Z1 and Z2) slurry. If it is hydrocarbon based, it can be injected in-line to the added with the naphtha.

Water coming off the bottom of extractor 6 is routed to a water separation unit (not shown). For example, the aqueous stream coming off the bottom of extractor 6 can be chemically treated as necessary, for example with a coagulant, a flocculent, and/or possible pH adjusting reagents. Some zeolite can optionally be added to the stream. The aqueous stream can then be routed into a clarifier for separation. The solids in the bottom of extractor 6 can be pulled off and routed directly to a surge tank (not shown) and/or a filter press unit for recovery and/or purification.

Returning to the co-current option, extract from extractor 6 overflows into a surge tank 18 where it accumulates and can optionally be pumped to solid/liquid hydrocyclone 20 to remove entrained solids from the liquid phase. Manufacturers of hydrocyclones report removal of 5 micron material in the correct fluid viscosity and density differences between the solid and liquid phase (e.g. sand in water). Lighter solids such as silt and clay are more difficult to remove on their own, however, the zeolite Z2 has a positive surface charge and contributes to "coagulation" of these finer, less dense particulate, facilitating their removal. As a result, much of the finer, less dense material undergoes a change in size and density, and will fall to the bottom of extractor 6, and will most probably never pass to hydrocyclone 20. However, if there is carryover, solid/liquid hydrocyclone 20 can act as a "slug catcher."

The underflow of the solid/liquid hydrocyclone 20 can be routed via a conduit (not shown) to the bottom of extractor 6, at about the interface between the hydrocarbon layer and water layer, so that solids are not re-contaminating the crude and have a minimum distance to settle out.

The overflow from solid/liquid hydrocyclone 20 can be routed to a liquid/liquid hydrocyclone 22, for removal of any entrained free water in order to minimize water concentration in the feed to extractor 24. Hydrocyclone 22 can be seen as a "slug catcher" for water.

The overflow from liquid/liquid hydrocyclone 22, which is a naphtha-modified, dewatered, desalted, de-metallized, solids-free, acid-free crude stream, is then routed to second extractor 24. The underflow from the liquid/liquid hydrocyclone 22, which is primarily water, can be routed back and injected at the level of the water layer in extractor 6 through a conduit (not shown).

The naphtha modified, dewatered, desalted, de-metallized, solids-free, acid-free crude stream can be combined with zeolites Z1 and/or Z2, ranging from about 10:0 to about 0:10. The ratio of zeolites can be adjusted depending on the crude. After mixing in an in-line mixer 26, the naphtha-modified, dewatered, desalted, de-metallized, solids-free, acid-free crude and zeolite mixture is routed to extractor 24. The extractor can be operated counter-currently or co-currently.

In extractor 24 there may be a multi-stage mixing and settling with a phase separation zone under the mixing stages for raffinate accumulation and a phase separation zone on top of the mixing stages for extract accumulation.

The solvent used in extractor 24 can be, for example, naphtha, which can be fed from an accumulator 28. A high performance asphaltenes precipitator can be selected dependent on crude and injected in-line from a tank 30 prior to the combined stream entering the extractor 24.

As described above, Z1 has a negative surface charge and Z2 has a positive surface charge. Z1 removes additional cations that may have been entrained in the extract from the first extractor column unit 6. It will also contribute to water droplet induction and coalescence. Z2 has a positive surface charge and will adsorb anions and negatively charged fine particles from the hydrocarbon phase. Additionally, Z2 may be slurried in naphtha that is spiked with an asphaltene precipitator. The surface of Z2 is also oleophilic, and therefore the alkanes and the asphaltene precipitator partition to the surface of the Z2. This results in asphaltenes precipitation on to the surface of the Z2 particle, resulting in a density change for the precipitating asphaltenes. Self-agglomeration of the precipitating asphaltenes on the surface is also likely to occur.

Extractor 24 functions due in-part to density differences, with the heavy phase of asphaltenes and solids (and any remaining water) falling to the bottom of the extractor 24, and the substantially cleaned, dried, deasphalted, naphtha-modified, possible heated, crude rising to the top of extractor 24 as the extract.

The extract from extractor 24 can then overflow into a surge drum 32 and can be pumped through a heat exchanger 34 and optionally to a solid/liquid hydrocyclone (not shown). Optionally, the overflow from the solid/liquid hydrocyclone can then be routed into a deep bed filter 36 with mixed media of Z1 and Z2 having particle sizes, for example, ranging from about 50 to 200 microns. The purpose of deep bed filter 36 is to provide a final polish to the crude, removing any remaining salt and acid (if required by client specification) prior to entering the diluent recovery section of the process.

The mixture leaving filter 36 can be treated to separate the crude from the solvent. For example, a series of flash drums can be used to remove naphtha from the crude stream to recycle the naphtha for re-use. The hydrocarbon product, or synthetic crude, originating from the flash drum(s) can be fed forward for secondary upgrading by the existing refinery units. For the application of the described processes for upgrading Athabasca Bitumen with 17% asphaltenes and 17% solids concentrations (assumed0, the product stream is estimated to contain about 50% distillate and 50% vacuum gas oil, according to an exemplary embodiment.

Asphaltenes combined with zeolite and other hydrocarbons come off the bottom of deasphalting extractor 24, as the raffinate. The stream is routed to a mixing vessel 60 where it is combined with toluene (toluene stream not shown), held, and mixed. The contents of vessel 60 are then routed to a clarifier 62, where the solids fall to the bottom, and toluene/asphaltenes/hydrocarbon mixture becomes the supernatant.

The zeolite solids can then be routed to a dryer 64 where the remaining toluene is evaporated from the solid's surface. The dried solids can then be pneumatically conveyed to mixer 124 where they are washed with NaCl, sent to mixer 126 where the particles are rinsed with water, and then routed to separator 128 where the particles separate from the water stream. The particles are then sent to spray dryer 66 where hot nitrogen can be introduced to regenerate the surface and pores of the zeolite particles. The particles can then be conveyed to a dryer 68 where they are cooled and then optionally sprayed with surface modifier (possibly including, but not limited to, a quaternary amine). The particles can be further dried and stored for re-use.

The overhead from clarifier 62 containing the toluene/asphaltenes/hydrocarbon is sent can be treated to flash off the toluene and naphtha fractions. The overhead from flash drum can distilled to separate the toluene from the naphtha, and both solvents can be recycled.

The reduction in impurities will enhance the typical run length of a crude distillation unit prior to having to shutdown for maintenance, such as cleaning of heat exchangers and decoking of furnace tubes. In addition, the distillation bottoms, either atmospheric tower bottoms or vacuum distillation tower bottoms, will comprises less solids, salts, and asphaltenes, thereby improving efficiency of downstream unit operations.

Undiluted, extra heavy crude or bitumen such as Athabasca can be treated at an existing refinery using essentially the same process steps and apparatus illustrated in FIG. 1.

One of skill in the art will appreciate that the disclosed process can be implemented in a variety ways. For example, if a refinery receives diluted, extra heavy crude (e.g. Athabasca+Diluent), the disclosed process can be installed before the desalter. Doing so provides a way to upgrade the acidic, heavy crude to lighter, cleaner feedstock for the refinery by removing asphaltenes (and NSO and metals contained therein), decreasing particulate content in feedstock, which in turn reduces wear in downstream rotating equipment and plugging of catalyst beds, decreases catalyst deactivation. The process also reduces corrosion through naphthenic acid and salt removal, removing additional heteroatoms contained in the acids; reduces desalter operational issues caused by emulsions; and produces a product depleted in ultra-fines or aromaticity issues.

The refiner realizes benefits such as improved product slate, increased fuels production; reduced production of atmospheric pollutants; longer catalyst life; and increased refinery profitability. The refiner is able to produce a refinery feedstock with a reduced level of heteroatoms. The product mixture will comprise predominately distillate and vacuum gas oil boiling range components.

A refinery receiving undiluted heavy crude (e.g. Merey), can install the disclosed process unit before desalter. This improves desalter operation by eliminating emulsion issues; removes asphaltenes, salts, acids, and other contaminants; produces an upgraded crude product without ultra-fines, aromaticity issues; reduces deactivation and plugging of catalyst beds; reduces corrosion in refinery equipment.

The disclosed process can be implemented at the production facility that produces, for example, extra heavy crude (e.g. Athabasca bitumen produced using Steam Assisted Gravity Drainage) that cannot be pipelined w/o diluents. The process breaks emulsions; removes asphaltenes and other contaminants; upgrades crude, resulting in higher market value; provide excellent performance in remote locations; produces a product without aromaticity issues; produces a product without salt, acid, or ultra-fine issues. The process thereby improves pumpability of crude and reduces or eliminates the need for diluent to be added to the crude.

As an example, thick, acidic heavy bitumen (tar sand) is produced using Steam Assisted Gravity Drainage and must be diluted with naphtha to thin it before it can be pumped through a first pipeline from the producing field to refineries for processing. The diluent is distilled from the bitumen-diluent mixture at the refinery and the diluent is returned through a second pipeline to the producing field to dilute more bitumen. The heat and electrical energy used to recycle the diluent and the second pipeline represent unnecessary costs. If a small plant implementing the disclosed process is installed in the production field, the product can be sent for distillation and further processing in the existing refinery without adding a diluent. The quality of the refinery feedstock is improved due to reduced contaminants, salinity, water, acidity, asphaltenes, heteroatoms, and fines. Reduced heteroatoms may result in a reduced load on hydrotreater catalyst. Special metallurgy in crude distillation columns may not be required to mitigate corrosion resulting from naphthenic acids. A better quality cracking feedstock for FCC's may be produced.

The disclosed process can be implemented in bitumen (tar sand) production obtained from surface mining and hot water extraction. Tar sand bitumen is surface mined in a solid form and moved to the processing operation using trucks. Once at the bitumen production plant, the solid bitumen is mixed with hot water and caustic, the bitumen is removed as froth, and is then further upgraded by the refinery. The disclosed process can be substituted for the extraction and separation process currently used in the surface mining operation, resulting in a deasphalted, acid-free, salt-free, dehydrated bitumen, having a higher market value. Additionally, the problems associated with Bitumen Derived Crudes (BDC), such as aromaticity and ultra-fines content, are minimized with the inventive technology, which may allow it's product to be used as FCC feedstock. The ultra-fines and aromaticity issues have resulted in significant problems for BDC's (and other coked bitumen) to be marketed as FCC feedstock. With the ultra-fines and aromaticity issues minimized, the refinery processing the deasphalted bitumen produced by the disclosed process can save significant costs because of refining a higher valued feedstock.

EXAMPLES

Example 1

Heavy Crude

Heavy crude from the Mississippi area (30 grams) was diluted with naphtha (17 grams) in a test tube. Zeolite (1.5 grams, GSA Resources, Inc. product number 500RW), demulsifier (1000 ppm, Baker Hughes product number RE4555DM0), and of an asphaltenes precipitant (500 ppm, Baker Hughes product number RE4877ASO) were added to the crude composition. Upon stirring for 5 minutes a water layer formed on the bottom of the tube. The test tube was centrifuged at 1000 rpm for 10 minutes. The mixture separated into four layers: hydrocarbon/asphaltenes/water/solids. The procedure was repeated with another 30 gram sample of crude and the combined supernatants were combined and analyzed (Sample 1A).

Sample 1A (30 grams) was further contacted with naphtha (7.5 grams) and the same zeolite (0.8 grams), asphaltenes precipitant (500 ppm), and demulsifier (1000 ppm) as described in the preceding paragraph. The mixture was centrifuged at 1000 rpm for 10 minutes and the hydrocarbon supernatant was analyzed (Sample 1B). The composition of Samples 1A and 1B are presented in Table 2 and the removal efficiencies for the samples are shown in Table 3.

TABLE 2

Results of Contacting Heavy Crude with Additive Package

| | Crude | Sample 1A | Sample 1B |
|---|---|---|---|
| TSS (mg/L) | 22,250 | 150 | 100 |
| Asphaltene (wt %) | 5.87 | 3.6 | 2.5 |
| Water (wt %) | 15.63 | 0.772 | 0.172 |
| Hydrocarbon (wt %) | 76.3 | 95.63 | 97.33 |
| Asphaltene/Hydrocarbon | 0.077 | 0.038 | 0.024 |
| SG ( ) | 1.004 | 0.8196 | 0.7848 |
| Viscosity (cP) | 525 | 4.01 | 2.11 |

TABLE 3

Contaminant Removal Efficiencies

| Component | Removal in Stage 1 (%) | Removal in Stage 2 (%) |
|---|---|---|
| Solids | 99.3 | 99.6 |
| Asphaltene/Hydrocarbon | 51 | 69 |
| Water | 95.1 | 98.9 |

The disclosed process provides good water drop, solids removal efficiency, and asphaltenes/HC removal. The analytical data based on the laboratory experiments show that removal of only 69% of the asphaltenes contributes to affecting almost 99% of water removal. Since almost all of the water is removed from a dispersed, emulsified state, it is likely that almost all of the salt in the water phase was also removed.

Table 1 reflects a significant reduction in viscosity. This is due to: diluent addition, emulsion breakage, water removal, and asphaltenes removal. (at 40 deg C.) Conventional crude has a viscosity of about 11 cP (at 50 deg C.), medium crude is about cP (at 40 deg C.), and heavy is about 619 cP (at 40 deg C.).

I claim:

1. A process for removing contaminants and breaking emulsions in a feedstream comprising a crude source composition comprising unconventional or opportunity crude oil, the process comprising:

providing the feedstream comprising the crude source composition comprising unconventional or opportunity crude oil, the feedstream comprising an emulsion comprising one or more contaminants, a salt content, and a water content; and, contacting the feedstream directly with one or more mesopore structured materials and one or more demulsifiers under conditions effective to separate a majority of the water content, the salt content, and the one or more contaminants from the feedstream, thereby breaking the emulsion and producing a purified hydrocarbon phase; and, contacting the feedstream with one or more asphaltene precipitants.

2. The process of claim 1 wherein:

the unconventional or opportunity crude oil is selected from the group consisting of acidic crude oil, extra heavy oil, heavy oil, high salinity crudes, acidic residuum, oil sand, diluted bitumen, undiluted bitumen, and a mixture thereof; and, the one or more contaminants is selected from the group consisting of asphaltenes, bulk solids, sulfur, NSO, metals, chlorides, salts, surfactants, and a mixture thereof.

3. The process of claim 1 wherein the one or more contaminants comprise chlorides.

4. A process for removing contaminants and breaking emulsions in a feedstream comprising a crude source composition comprising unconventional or opportunity crude oil, the process comprising:

providing the feedstream comprising the crude source composition comprising unconventional or opportunity crude oil, the feedstream comprising an emulsion comprising one or more contaminants, a salt content, and a water content; and, diluting the feedstream, producing a diluted feedstream;

contacting the diluted feedstream with a first mesopore structured material and one or more demulsifiers under separation conditions effective to produce first phases comprising a solid phase and an aqueous phase;

separating at least a portion of the solid phase and at least a portion of the aqueous phase from the first phases to leave a remainder comprising a hydrocarbon phase.

5. The process of claim 4 further comprising:

contacting the remainder with a second mesopore structured material and one or more reagents under second separation conditions effective to produce second phases comprising a hydrocarbon phase;

separating-purified hydrocarbon from the hydrocarbon phase.

6. The process of claim 4 further comprising contacting the diluted feedstream with one or more asphaltene precipitants.

7. A process for removing contaminants and breaking emulsions in a feedstream comprising a crude source composition comprising unconventional or opportunity crude oil, the process comprising:

providing the feedstream comprising the crude source composition comprising unconventional or opportunity crude oil comprising an emulsion, the feedstream comprising one or more contaminants, a salt content, and a water content; and, contacting the feedstream directly with one or more zeolitic materials and one or more demulsifiers under conditions effective to separate a majority of the water content, the salt content, and the one or more contaminants from the feedstream, thereby breaking the emulsion and producing a purified hydrocarbon phase; and, adding to the feedstream one or more asphaltene precipitants.

8. The process of claim 7 wherein:

the unconventional or opportunity crude oil is selected from the group consisting of acidic crude oil, extra heavy oil, heavy oil, high salinity crudes, acidic residuum, oil sand, diluted bitumen, undiluted bitumen, and a mixture thereof; and, the feedstream comprises one or more contaminants comprising asphaltenes, bulk solids, sulfur, NSO, metals, chlorides, salts, surfactants or combinations thereof.

9. The process of claim 7 wherein the one or more contaminants comprise chlorides.

10. A process for removing contaminants and breaking emulsions in a feedstream comprising a crude source composition comprising unconventional or opportunity crude oil, the process comprising:

providing the feedstream comprising the crude source composition comprising unconventional or opportunity crude oil comprising an emulsion, the feedstream comprising one or more contaminants, a salt content, and a water content; and, diluting the feedstream, producing a diluted feedstream;

contacting the diluted feedstream with a first zeolitic material and one or more demulsifiers under conditions effective to separate a majority of the water content, the salt content, and the one or more contaminants from the feedstream, thereby breaking the emulsion and producing a purified hydrocarbon phase; and, contacting the diluted feedstream one or more asphaltene precipitants.

11. A process for removing contaminants and breaking emulsions in a feedstream comprising a crude source composition comprising unconventional or opportunity crude oil, the process comprising:

providing the feedstream comprising the crude source composition comprising unconventional or opportunity crude oil comprising an emulsion, the feedstream comprising one or more contaminants, a salt content, and a water content; and, diluting the feedstream, producing a diluted feedstream;

contacting the diluted feedstream with a first zeolitic material and one or more demulsifiers under conditions effective to separate a majority of the water content, the salt content, and the one or more contaminants from the feedstream, thereby breaking the emulsion and producing a purified hydrocarbon phase;

wherein the conditions are effective to produce first phases comprising a solid phase and an aqueous phase, the method further comprising separating at least a portion of the solid phase and at least a portion of the aqueous phase from the first phases to leave a remainder comprising a hydrocarbon phase.

12. The method of claim 11 further comprising:

contacting a remainder with a second zeolitic material and one or more reagents under second separation conditions effective to produce second phases comprising a hydrocarbon phase; and, separating the purified hydrocarbon from the hydrocarbon phase.

13. A process for removing contaminants and breaking emulsions in a feedstream derived from a crude source composition comprising unconventional or opportunity crude oil, the process comprising:

providing the feedstream wherein the unconventional or opportunity crude oil is selected from the group consisting of acidic crude oil, extra heavy oil, heavy oil, high salinity crudes, acidic residuum, oil sand, diluted bitumen, undiluted bitumen, and a mixture thereof, the feedstream comprising an emulsion comprising one or more contaminants, a salt content, and a water content;

contacting the feedstream with one or more mesopore structured materials and one or more demulsifiers under conditions effective to separate a majority of the water content, the salt content, and the one or more contaminants from the feedstream, thereby breaking the emulsion and producing a purified hydrocarbon phase; and, contacting the feedstream with one or more asphaltene precipitants.

14. A process for removing contaminants and breaking emulsions in a feedstream derived from a crude source composition comprising unconventional or opportunity crude oil, the process comprising:

providing the feedstream wherein the unconventional or opportunity crude oil is selected from the group consisting of acidic crude oil, extra heavy oil, heavy oil, high salinity crudes, acidic residuum, oil sand, diluted bitumen, undiluted bitumen, and a mixture thereof, the feedstream comprising an emulsion comprising one or more contaminants, a salt content, and a water content;

contacting the feedstream with one or more zeolitic materials and one or more demulsifiers under conditions effective to separate a majority of the water content, the salt content, and the one or more contaminants from the feedstream, thereby breaking the emulsion and producing a purified hydrocarbon phase; and, contacting the feedstream with one or more asphaltene precipitants.

* * * * *